US005416550A

United States Patent [19]

Skye et al.

[11] Patent Number: 5,416,550

[45] Date of Patent: May 16, 1995

[54] PHOTOGRAPHIC PROCESSING APPARATUS

[75] Inventors: David A. Skye, Harpenden; Anthony Earle, Harrow Weald; Nicholas J. Taylor, Harrow Weald; Paul C. Ward, Watford, all of United Kingdom

[73] Assignee: Eastman Kodak Company, Rochester, N.Y.

[21] Appl. No.: 30,064

[22] PCT Filed: Sep. 11, 1991

[86] PCT No.: PCT/EP91/01728

§ 371 Date: May 3, 1993

§ 102(e) Date: May 3, 1993

[87] PCT Pub. No.: WO92/05472

PCT Pub. Date: Apr. 2, 1992

[30] Foreign Application Priority Data

Sep. 14, 1990 [GB] United Kingdom ..... 9020124

[51] Int. Cl.[6] ..... G03D 3/02

[52] U.S. Cl. ..... 354/298; 354/321; 354/334

[58] Field of Search ..... 354/298, 317–324, 354/334; 355/40, 41, 68, 77

[56] References Cited

U.S. PATENT DOCUMENTS

| | | | |
|---|---|---|---|
| 2,296,048 | 9/1942 | Planskoy | 95/89 |
| 3,462,221 | 8/1969 | Tajima et al. | 355/77 |
| 3,680,463 | 8/1972 | Attridge et al. | 95/89 |
| 3,785,268 | 1/1974 | Gregg et al. | 95/89 |
| 4,881,095 | 11/1989 | Shidara et al. | 354/298 |

FOREIGN PATENT DOCUMENTS

| | | |
|---|---|---|
| 1200243 | 12/1959 | France . |
| 2542881 | 3/1983 | France . |
| 1364439 | 8/1974 | United Kingdom . |
| WO91/10940 | 7/1991 | WIPO . |
| WO91/10941 | 7/1991 | WIPO . |

*Primary Examiner*—D. Rutledge
*Attorney, Agent, or Firm*—Frank Pincelli

[57] ABSTRACT

It is known to use infra-red densitometry to measure the variations in the optical density of photographic material. In photographic processing apparatus, it is important that the photographic material is transferred from one part of the apparatus to another at precisely the correct time to prevent damage to the material. Described herein is a method and apparatus for controlling the transfer or switching of photographic material from one processing tank to another of photographic processing apparatus during processing of the material. A threshold detector (30) is used to produce an output signal (40) indicative of a change in infra-red density of the photographic material. The output signal (40) is then used to control the transfer or switching of the material from one processing tank to another.

7 Claims, 3 Drawing Sheets

PHOTOGRAPHIC PROCESSING APPARATUS

This invention relates to photographic processing apparatus and is more particularly concerned with infra-red densitometry for determining the position of photographic material within such apparatus.

BACKGROUND OF THE INVENTION

It is known to use infra-red densitometry to measure the variations in the optical density of a moving web. British Patent Specification GB-A-1364439 discloses such a method which comprises illuminating a spot on the moving web with a source of infra-red radiation and using a photosensitive detector positioned on the opposite side of the web from the source to measure the diffused radiation issuing from the web. A radiation-absorbing screen is used to prevent specular radiation from reaching the detector. The energy impinging on the detector is related to the distance of the web from the detector. The optical density of the web can then be determined from the level of radiation received by the detector. The arrangement is such that the optical density measurement is not affected by any vibrations produced in the moving web.

SUMMARY OF THE INVENTION

International Patent Applications WO-A91/10941 & WO-A-91/10940 (British Patent Applications 9000637.0 and 9000620.6 respectively) disclose the use of infra-red densitometry to monitor the infra-red density of photographic film. In the former case, the infra-red density of the film at any stage provides an indication of the amount of processing which the film has undergone. In the latter case, the infra-red density of the film is used to determine replenishment needs for photographic processing apparatus.

It is known to use cyclic processing apparatus for processing photographic material. In such apparatus, photographic material is made to travel around a continuous loop whilst it is totally immersed in processing solutions. The material is maintained in a particular processing solution until the requisite processing time has elapsed. The material is then transferred into the processing solution of the next stage of the processing apparatus. Material transport speed needs to be high so that the time for which the material spends in the air during such transfer is minimised. This is because air causes oxidation of many of the photographic processing materials used and rapidly reduces their effectiveness.

It is important that the transfer or switching mechanisms are operated at precisely the correct time to prevent damage to the material being transferred from one processing solution to the next.

It is therefore an object of the present invention to provide apparatus and method for controlling such transfer or switching of photographic material from one processing tank to another during processing of the material.

According to one aspect of the present invention, there is provided photographic processing apparatus for processing photosensitive material, the apparatus comprising:

at least one processing tank;

a densitometer arrangement associated with each processing tank and positioned substantially close to the entrance to the processing tank, the densitometer arrangement being operable to measure the infra-red density of the photosensitive material; and processing means for processing an output signal from the densitometer arrangement;

characterized in that the processing means includes a threshold detector which provides the output signal when a change of infra-red density is detected, and in that the output signal is used to control the transfer of photosensitive material from one processing tank to another.

Advantageously, an infra-red opaque label is attached to the photosensitive material to generate the change in infra-red density.

BRIEF DESCRIPTION OF THE DRAWINGS

For a better understanding of the present invention, reference will now be made, by way of example only, to the accompanying drawings in which.

Although the present invention will now be described with reference to the processing of photographic film, it is equally applicable to any cyclic processing apparatus in which the material being processed needs to be accurately transferred from one tank to another.

DETAILED DESCRIPTION OF THE INVENTION

The present invention can be applied to apparatus in which there are a plurality of processing tanks. However, the invention will now be described with reference to a single processing tank.

In the present invention, measurements and/or readings are taken by an infra-red sensitive arrangement. However, as the infra-red density of the film falls to zero after fixing, an infra-red opaque label must be attached to the leading edge of the film so that it can be detected by the infra-red sensitive arrangement.

Figure 1:
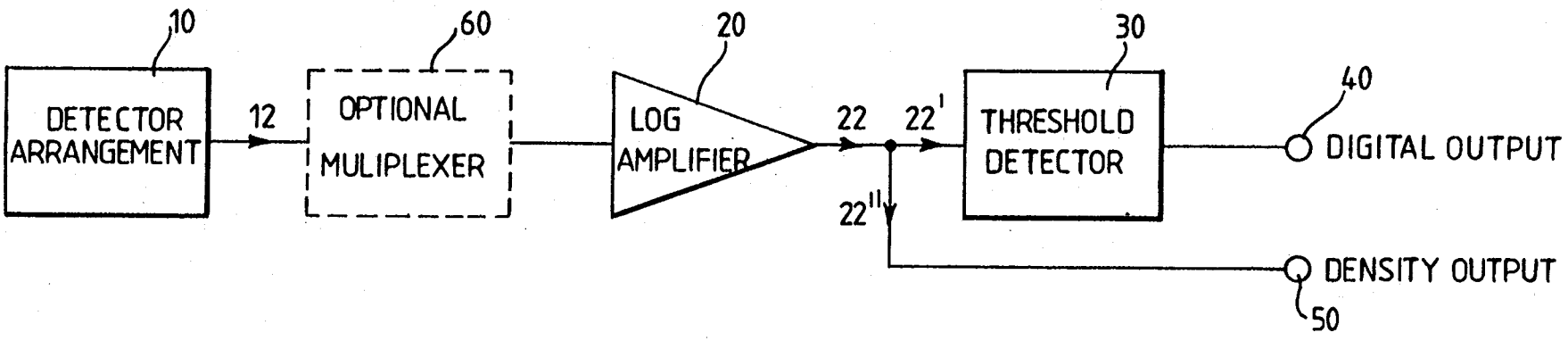
FIG. 1 is a schematic block diagram of apparatus constructed in accordance with the present invention.
Figure 2:
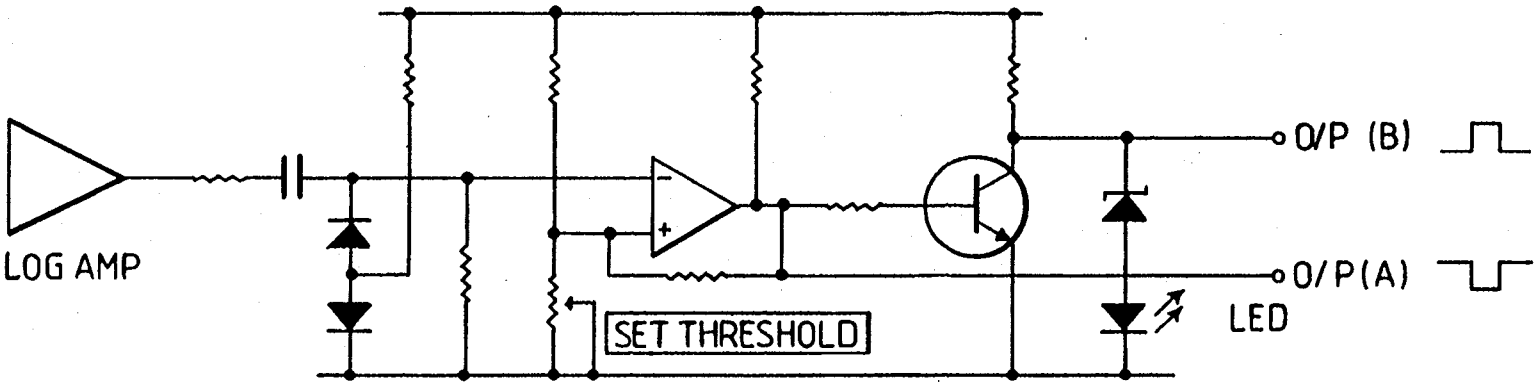
FIG. 2 is a circuit diagram of a threshold detector circuit as used in the apparatus of FIG. 1
Figure 3:
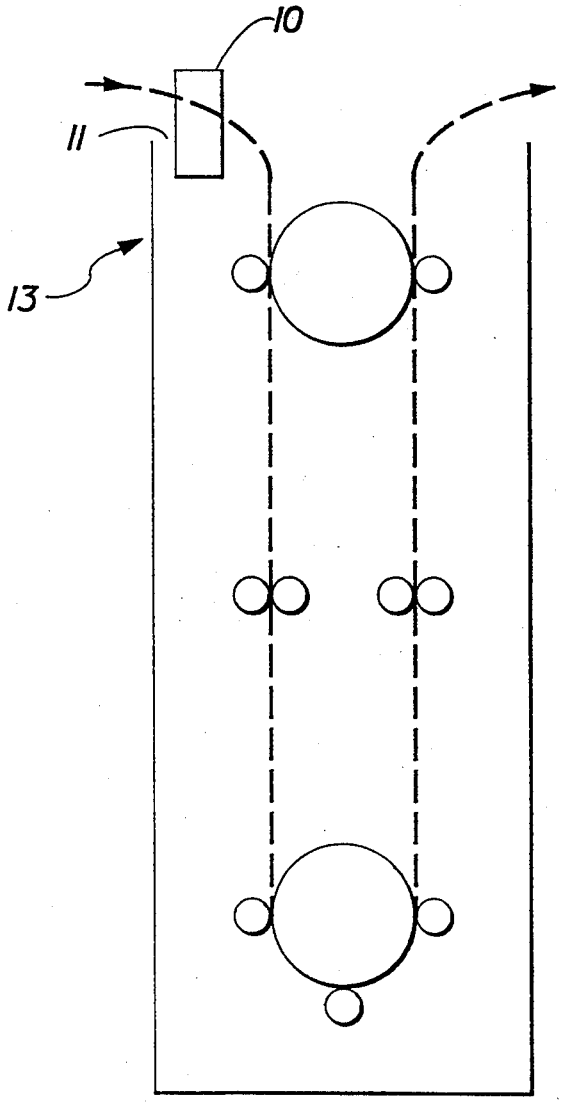
FIG. 3 is a schematic diagram of a photographic processing apparatus made in accordance with the present invention.

The apparatus, as shown in FIG. 1, comprises an infra-red densitometer detector arrangement/assembly 10 which is located close to the film entrance 11 in a processing tank 13. The detector arrangement 10 operates both to project infra-red radiation on to the film as it passes by it and to detect radiation emanating from the film.

Any suitable infra-red source (not shown) may be used. An infra-red sensor is mounted in the detector arrangement 10 for detecting radiation transmitted by the film.

An output signal 12 from the detector arrangement 10 is then passed to a logarithmic amplifier 20 which amplifies the signal. A part 22' of the amplified signal 22 is then passed to a threshold detector 30 which is connected to provide a digital output signal at 40. The digital output signal is produced when a change of infra-red density is detected, for example as the infra-red opaque label passes the detector arrangement 10, and is then used by a computer (not shown) to control film movement within the processing apparatus.

Another part 22'' of the amplified signal 22 provides an output 50 which corresponds to the analogue value of the infra-red density of the film.

If more than one film is to be processed simultaneously, a separate infra-red detector arrangement is required for each film. However, although such a configuration of detector arrangements gives the greatest flexibility, it also tends to be costly to implement.

Alternatively, a multiplexer 60 may be used to allow more than one film to be processed at the same time. The use of the multiplexer 60 is optional and is only required if the output signal from more than one densitometer detector arrangement 10 is to be amplified by the same logarithmic amplifier/threshold detector pair 20, 30.

If the output signals from more than one densitometer detector arrangement 10 is to be processed by a single logarithmic amplifier/threshold detector pair 20, 30, data from only one tank can be processed at one time. However, by choosing a suitable multiplexing rate and having sufficient computer power and speed, all the process stages can be scanned continuously. In this case, the data acquisition rate must be fast enough to catch the opaque label whenever it passes the densitometer arrangement 10. In the present case, a data acquisition rate of the order of 2ms is used.

Alternatively, the densitometer detector arrangements may be grouped in twos or threes, each group being multiplexed to a logarithmic amplifier/threshold detector pair.

Each infra-red densitometer detector arrangement 10 is used to measure the length of the photographic film in the processing tank. As the film is introduced into developer solution in the processing tank, its infra-red density starts to rise. All the time the film is in the developer solution, its infra-red density is above a detection threshold. As the film passes the densitometer head, a signal is generated by the threshold detector 30 and indicates to a control computer (not shown) that film is present. After the film has made one circuit around the loop, a second signal is generated. During this time, a separate micro-controller (not shown) is reading and processing the analogue infra-red density data.

The film is permitted to make two complete passes of the loop to allow it to soften, and then the film length and cycle time are measured. The cycle time is measured between successive film edge detections. The length of the total film path is fixed and is therefore known. The time between detecting the leading edge and the trailing edge of the film represents the film length.

The film length is given by:

$$\text{film length} = \frac{t_{film}}{t_{cycle}} \cdot d$$

where $t_{cycle}$ is the cycle time;

$t_{film}$ is the time for the film presence; and d is the film path length.

This information is calculated by the computer during the third pass and this value is then used in relation to that particular film as it passes through the rest of the processing apparatus.

The cycle time is continuously monitored for each pass to cope with possible variations in film transport speed.

The distance from the infra-red sensor to the film switching point is fixed and is therefore known. the computer calculates the switching time from data stored in it which is related to the time that the film first entered the processing solution, that is the first detection in that processing solution. Using the most recently acquired value of the cycle time, the computer then calculates the precise moment at which to operate the transfer or switching mechanism. The algorithm used by the computer to do this calculates the switching time to the nearest half-cycle. This gives an absolute accuracy in the processing time of $\pm/-0.5t_{cycle}$.

It may be advantageous to have the motor speed of the drive system controlled by the computer. This means that after the length of the film and the cycle time have been measured, the computer can calculate the motor speed required to give the precise time in the most critical solution of the processing cycle (namely, in the developer).

A time window may be used for the detection of the leading edge of the film. Once the cycle time and the length of the film have been measured, film sensing is disabled until a few tenths of a second before the leading edge is expected, based on the most current value of cycle time. This feature is particularly important during fixing as the infra-red density of the film gradually falls to zero. In this period, high and low density infra-red density regions on the film may cause spurious detections. Window detection as described above overcomes this problem.

It is important to note that at the end of fixing and in subsequent processing solutions, only the infra-red opaque label on the film will generate the film position signal.

There are substantial advantages in using infra-red densitometer arrangements for determining film position information, one of these being that no mechanical parts are required. This keeps the film track in the processing apparatus clear with less likelihood of film jams. Another advantage is that densitometer arrangements are already in use in some processing tanks, and the same arrangement, in conjunction with appropriate computer software, could be used to determine the film position thereby providing a cost effective arrangement.

We claim:

1. Photographic processing apparatus for processing photosensitive material, the apparatus comprising:

at least one cyclic processing tank;

a densitometer arrangement (10) associated with each cyclic processing tank and positioned substantially close to the entrance to the cyclic processing tank, the densitometer arrangement (10) being operable to measure the infra-red density of the photosensitive material; and processing means (20, 30, 60) for processing an output signal (22, 22', 22'') from the densitometer arrangement (10) and including a threshold detector (30);

characterized in that the threshold detector (30) provides the output signal (22, 22', 22'', 40) when a step change of infra-red density of the photosensitive material is detected, and in that the output signal (22, 22', 22'', 40) provides positional information relating to the photosensitive material being processed which is used to control the transfer of photosensitive material from one cyclic processing tank to another processing tank.

2. Apparatus according to claim 1, wherein an infra-red opaque label is attached to the photosensitive material to generate the step change in infra-red density after removal of infra-red sensitive components in the photosensitive material.

3. Apparatus according to claim 1 or 2, wherein the processing means (20, 30, 60) further includes a logarithmic amplifier (20) which amplifies a signal (12) from the densitometer arrangement (10) to produce the output signal (22, 22', 22'', 40)

4. Apparatus according to claim 1, wherein the processing means (20, 30, 60) further includes a multiplexer (60).

5. A method for processing photosensitive material in photographic processor having at least one cyclic processing tank, said method comprising the steps of:

using a densitometer assembly in association with said cyclic processing tank;

measuring the infrared density of the photosensitive material entering the processing tank using a processing assembly having processing means for processing an output signal from the densitometer assembly, said processing means including a threshold detector, said threshold detector providing an output signal with a step change in infra-red density of the photosensitive material, said output signal providing positional information relating to the photosensitive material being processed; and using said output signal to control the transfer of photosensitive from one cyclic processing tank to another processing tank.

6. A method according to claim 5 further comprising the steps of attaching an opaque label to the photosensitive material so as generate the step change in the infra-red density after removal of the infrared-sensitive components in the photosensitive material.

7. A method according to claim 5 further comprising the steps of amplifying a signal from the densitometer assembly with a logarithmic amplifier so as to produce an output signal.

* * * * *